United States Patent [19]

Takahashi

[11] 4,366,236

[45] Dec. 28, 1982

[54] PHOTOGRAPHIC MATERIALS

[75] Inventor: Osamu Takahashi, Minami-ashigara, Japan

[73] Assignee: Fuji Photo Film Co., Ltd., Kanagawa, Japan

[21] Appl. No.: 240,668

[22] Filed: Mar. 5, 1981

[30] Foreign Application Priority Data

Mar. 5, 1980 [JP] Japan ..... 55-28253

[51] Int. Cl.[3] ..... G03C 1/76

[52] U.S. Cl. ..... 430/505; 430/218; 430/215; 430/502

[58] Field of Search ..... 430/218, 215, 502, 505

[56] References Cited

U.S. PATENT DOCUMENTS 4,267,250 5/1981 Sakawoue et al. ..... 430/502

4,293,641 10/1981 Takahashiet al. ..... 430/502

*Primary Examiner*—John E. Kittle

*Assistant Examiner*—John L. Goodrow

*Attorney, Agent, or Firm*—Sughrue, Mion, Zinn, Macpeak & Seas

[57] ABSTRACT

A diffusion transfer color photographic material having an improved interlayer between two silver halide photographic emulsion layers formed on a support. The interlayer contains a mixture of hydroquinone derivatives having solidifying points lower than 100° C. and a water-insoluble organic solvent-soluble homopolymer or copolymer dispersed in a hydrophilic organic colloid.

10 Claims, No Drawings

PHOTOGRAPHIC MATERIALS

FIELD OF THE INVENTION

This invention relates to photographic materials and, more particularly, to multilayer color photographic materials. Furthermore, the invention is especially concerned with an interlayer which improves color separability and also is effective for increasing the maximum density of dye images.

BACKGROUND OF THE INVENTION

In a color diffusion transfer photographic material of a type that the photographic material contains compounds which release diffusible dyes by the redox reaction induced by the light exposure and development of silver halide (hereinafter, such a compound is referred to as a diffusible dye releasing type redox compound) and is developed using a black-and-white developing agent such as phenidone, it is required that the oxidation product of the developing agent formed by the development of silver halide reacts with only the dye releasing redox compound associated therewith. *Research Disclosure,* Vol. 152, No. 15,162 (published Nov. 1976), etc., discloses a layer containing a material which can properly react with the oxidation product of the developing agent. For example, it shows a color mixing inhibitor such as a hydroquinone derivative, etc., for preventing the oxidation product of the developing agent from diffusing into layers containing other dye releasing redox compounds which are not associated with the oxidation product.

Such hydroquinones are incorporated in an interlayer and should be diffusion-resistant (non-diffusible); in order to impart a diffusion-resistant property to hydroquinones, it is required that a ballast group(s) having at least about 20 carbon atoms be contained in the hydroquinones for practical use. Typical examples of such hydroquinone derivatives as a color mixing inhibitor are alkylhydroquinones and dialkylhydroquinones. However, most of these hydroquinone derivatives are solid, so that they tend to crystallize out before, during and after coating.

Hydroquinone derivatives in a non-solid form have been proposed in U.S. Pat. No. 3,700,453. The hydroquinone derivatives disclosed therein are eutectic mixtures (semi-eutectic mixtures) of them and hence the eutectic point thereof is low. Therefore, they do not need high-boiling dispersing oils for obtaining stable emulsified dispersions. In more detail, even if a high-boiling dispersing oil does not exist in a hydrophilic colloid layer containing the hydroquinone derivatives, the deposition of the hydroquinone derivatives does not occur in the layer before, during, or after coating the layer.

In U.S. Pat. No. 3,982,944, hydroquinone derivatives which can provide more stable dispersions are disclosed.

However, these hydroquinone derivatives which are eutectic mixtures (or semi-eutectic mixtures) are undesirable in that they cause various side-effects by migrating into other photographic layers of a multilayer color photographic material. The intermixing of components dispersed in other layers into the color mixing inhibiting layer containing the hydroquinone derivatives occurs since many of these hydroquinone derivatives are in liquid states at room temperature or at temperatures slightly higher than room temperature. The disadvantages created by the side effect are similar to those frequently observed when incorporating high-boiling solvents (oils) in photographic materials. There is a reduction in the preservability of photographic materials (e.g., occurrence of color mixing between photographic layers when preserved at high temperatures, etc.), a reduction in adhesion between photographic layers, exudation of oily hydroquinone derivatives to the surface of a photographic material, etc. If the proportion of a hydrophilic colloid binder (e.g., gelatin) to liquid hydroquinone derivatives is low, the above-described tendency increases. This inevitably results in hindering the reduction of the thickness of photographic layers. This problem occurs not only in photographic materials for color diffusion transfer process but also in so-called "conventional" color photographic materials using color couplers, etc.

When using conventional interlayers problems occur because the oxidation product of a developing agent necessary for forming images is reduced by the hydroquinones contained therein and consumed. Accordingly, the ratio of forming dye images by the reaction of the oxidation product of the developing agent and a dye image-providing compound to be reacted with the oxidation product is reduced. This results in lowering the maximum density of the dye images.

In attempting to immobilize the ballast-containing and oily hydroquinone derivatives described in U.S. Pat. Nos. 3,700,453 and 3,982,944, the use of water-soluble polymers containing -N-CO- in combination with these hydroquinone derivatives has also been proposed in U.S. patent application Ser. No. 143,232, filed Apr. 24, 1980. While this system eliminates the aforesaid disadvantages and provides a high maximum dye image density, it has been found that, when water-insoluble organic soluble polymers containing $$-\underset{\underset{O}{\|}}{C}-O-$$

and free of a nitrogen atom at a position adjacent to the carbonyl group are employed in place of the water-soluble polymers, the maximum dye image density can be even further improved.

SUMMARY OF THE INVENTION

By using the interlayers of this invention, the reaction of the oxidation product of a developing agent and the dye image-providing compound in a photographic material can be progressed predominatingly over the reaction of the oxidation product and hydroquinones in the interlayers while substantially functioning as an interlayer. Thereby higher maximum dye image density is obtained.

An object of this invention is, therefore, to provide photographic materials having color mixing inhibiting interlayers which do not reduce the desirable photographic properties of photographic materials by the exudation of a mixture of hydroquinone derivatives, a liquid color mixing inhibitor, into other layers or reducing the function as the color mixing inhibitor by the intermixing of foreign matters from other layers into the layer containing the hydroquinone derivatives.

Another object of this invention is to provide photographic materials having novel color mixing inhibiting interlayers effective for obtaining high maximum dye image density.

As the result of the various investigations, it has been discovered that the above-described objects of this invention can be effectively attained, resulting in photographic materials having improved photographic properties and thinner photographic layers.

The invention provides a photographic material comprising a support having formed thereon at least two silver halide photographic emulsion layers which form silver images upon the development by alkali processing solution in the presence of a silver halide developing agent after image-exposure. The invention is characterized by an interlayer disposed between a silver halide photographic emulsion layer and another silver halide photographic emulsion layer of said photographic material which contains hydroquinone derivatives having solidifying points of lower than 100° C. (said derivatives, however, differing from silver halide developing agent used for the development of the photographic material in that hydroquinones for use at silver halide developing agents should be capable of reducing silver halide to silver and thus soluble in an alkali (alkaline processing solution), whereas the hydroquinone derivatives used in accordance with this invention are insoluble in alkali). The invention is also characterized by a water-insoluble organic solvent-soluble homopolymer or copolymer having at the main chain or side chain thereof a recurring unit of $$-\underset{\underset{O}{\|}}{C}-O-,$$

and which is free of nitrogen atoms at positions adjacent to the $$-\underset{\underset{O}{\|}}{C}-O-.$$

The hydroquinone derivatives and polymer combined being dispersed in a hydrophilic organic colloid.

DETAILED DESCRIPTION OF THE INVENTION

Hydroquinone derivatives can be employed singly or in combination provided that they possess a solidifying point of lower than 100° C. Where hydroquinone derivatives are employed as a mixture thereof, the term "mixture" is used herein to refer to a mixture of at least two hydroquinone derivatives, including an isomer mixture. The isomer mixture generally forms a eutectic mixture, as described in U.S. Pat. Nos. 3,700,453 and 3,982,944, the disclosures of which are hereby incorporated by reference in this application. In this invention, a mixture of hydroquinone derivatives is preferred, and this invention will be described hereafter often with reference to a mixture form of hydroquinone derivatives as defined above.

The solidifying point of a mixture of hydroquinone derivatives is the temperature which coincides with the eutectic point of the mixture when the mixture has an eutectic point (in case of an eutectic mixture) or at which the mixture begins to solidify when the mixture does not have an eutectic point.

Preferred examples of the hyddroquinone derivative (color mixing inhibitor) used in this invention are a mixture of the hydroquinone compounds each having two tertiary alkyl groups of 15 carbon atoms at the 2 and 5 positions or the 2 and 6 positions of the benzene ring described in Japanese Patent Application (OPI) No. 29637/79 (U.S. Pat. No. 4,179,293) (the term "OPI" as used herein refers to a "published unexamined Japanese patent application") and isomer mixtures typified by a mixture of the secondary dodecylhydroquinone isomers described in U.S. Pat. Nos. 3,700,453 and 3,982,944.

These and other hydroquinone derivatives which can be employed in accordance with this invention are represented by the formulae (I) to (VI) below:

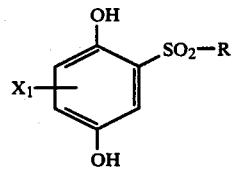

(I)

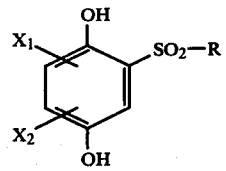

(II)

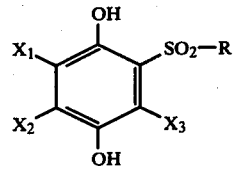

(III)

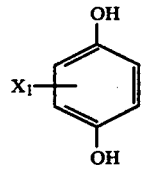

(IV)

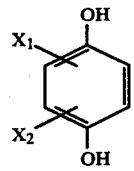

(V)

and

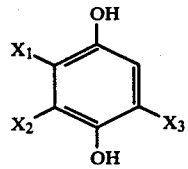

(VI)

wherein $X_1$, $X_2$ and $X_3$, which may be the same or different, each represents a halogen atom (e.g., chlorine atom, bromine atom, etc.); an aliphatic group such as an alkyl group having 1 to 22 carbon atoms (e.g., such straight chain or branched alkyl groups as methyl group, ethyl group, n-propyl group, isopropyl group, n-butyl group, tert-butyl group, n-pentyl group, n-decyl group, tert-decyl group, n-dodecyl group, sec-dodecyl group, tert-dodecyl group, n-pentadecyl group, secpentadecyl group, tert-pentadecyl group, sec-octadecyl group, tert-octadecyl group, etc.), a substituted alkyl group having 1 to 22 total carbon atoms, said substituent being a halogen atom (chlorine atom, bromine atom, etc.), a hydroxy group, an alkoxy group, a substituted amino group (including alkyl- or arylsulfamoyl group and alkyl- or arylcarbamoyl group), a cyano group, etc. (e.g., 4-chlorobutyl group, 2-hydroxyethyl group, 3-methoxypropyl group, 3-n-butylsulfamoylpropyl group, etc.), an alkenyl group having 3 to 22 carbon atoms (e.g., allyl group, etc.), a cycloalkyl group having 5 to 12 carbon atoms (e.g., cyclohexyl group, etc.), and an aralkyl group having 7 to 22 carbon atoms (e.g., benzyl group, phenethyl group, 4-methylphenylethyl group, etc.); an aryl group having 6 to 22 carbon atoms (in total) (e.g., phenyl group, phenyl group substituted by alkylsulfonyl group or arylsulfonyl group, etc.); an alkoxy group such as an alkoxy group having 1 to 22 carbon atoms, which may have been substituted (e.g., methoxy group, ethoxy group, n-butoxy group, n-dodecyloxy group, etc.); an aryloxy group such as an arylxoy group having 6 to 22 carbon atoms, which may have been substituted (e.g., phenoxy group, 4-n-butoxyphenyloxy group, etc.); an alkylthio group such as an alkylthio group having 1 to 22 carbon atoms, which may have been substituted (e.g., methylthio group, ethylthio group, n-pentylthio group, n-dodecylthio group, n-pentadecylthio group, 5-chloropentylthio group, etc.); or an arylthio group such as an arylthio group having 6 to 22 carbon atoms, which may have been substituted (e.g., phenylthio group, 4-nitrophenylthio group, etc.); said $X_1$ and $X_2$ may further form together with each other a condensed ring, preferably a 5- to 7-membered ring (e.g., cyclopentane ring, cyclohexane ring, cyclohexadiene ring, norbornene ring, etc.); and R represents an aliphatic group {such as an alkyl group having 1 to 22 carbon atoms (e.g., such straight chain or branched alkyl groups as methyl group, ethyl group, n-propyl group, n-butyl group, n-octyl group, n-decyl group, n-dodecyl group, i-pentyl group, etc.); a substituted alkyl group having 1 to 22 carbon atoms [such as ones having halogen atom (chlorine atom or bromine atom) as the substitutent (e.g., 2-chloroethyl group, 2-bromoethyl group, 3-chloropropyl group, 4-bromobutyl group, dichloromethyl group, etc.), ones having a hydroxy group as the substituent (e.g., 2-hydroxyethyl group, 3-hydroxypropyl group, 4-hydroxybutyl group, 6-hydroxyhexyl group, etc.), ones having a sulfonyl group as the substituent (e.g., ethanesulfonylmethyl group, n-butylsulfonylethyl group, alkylsulfonylbutyl group, etc.), ones having an alkoxy group (e.g., methoxy group, ethoxy group, n-butoxy group, n-hexyloxy group, etc.) as the substituent (e.g., methoxymethyl group, methoxyethyl group, ethoxyethyl group, n-butoxyethyl group, 3-methoxypropyl group, n-hexyloxoethyl group, etc.), ones having an alkylthio group (e.g., methylthio group, ethylthio group, n-hexylthio group, etc.) as the substituent (e.g., methylthiomethyl group, methylthioethyl group, 3-ethylthiopropyl group, n-hexylthioethyl group, etc.), and ones having a substituted amino group as the substituent (e.g., 4-(N,N-dimethylamino)butyl group, 5-acetamidopentyl group, 4-methylsulfonylaminobutyl group, anilinomethyl group, etc.)]; a cycloalkyl group (e.g., cyclohexyl group, etc.); a benzyl group having 7 to 22 carbon atoms, which may have been substituted (e.g., benzyl group, 4-methylbenzyl group, 4-chlorobenzyl group, phenethyl group, 4-methylphenylethyl group, etc.)}; or an aryl group having 6 to 22 carbon atoms (in total) such as a phenyl group and a substituted phenyl group {such as ones having a halogen atom (e.g., chlorine atom, bromine atom, etc.) as the substituent (e.g., 4-chlorophenyl group, 4-bromophenyl group, 2-chlorophenyl group, etc.); ones having a hydroxy group as the substituent (e.g., 2-hydroxyphenyl group, 4-hydroxyphenyl group, 2,5-dihydroxyphenyl group, etc.); ones having an alkyl group having 7 to 22 carbon atoms (in total) which may have been substituted as the substituent (e.g., 4-methylphenyl group, 4-i-propylphenyl group, 4-n-dodecylphenyl group, 2-chloro-4-methylphenyl group, 4-chloromethylphenyl group, 2,5-dihydroxy-4-alkylphenyl group, etc.); ones having an alkoxy group, which may have been substituted, as the substituent (e.g., 4-methoxyphenyl group, 4-ethoxyphenyl group, 4-n-propoxyphenyl group, 2-methyl-4-methoxyphenyl group, 3-methoxyphenyl group, 4-n-pentyloxophenyl group, 4-n-dodecyloxophenyl group, 3-n-pentadecyloxophenyl group, etc.); ones having an alkylthio group, which may have been substituted, as the substituent (e.g., 4-methylthiophenyl group, 4-ethylthiophenyl group, 4-n-butylthiophenyl group, 3-n-hexylthiophenyl group, 3-n-decylthiophenyl group, etc.); ones having an alkoxycarbonyl group (7 to 23 C) at the substituent (e.g., 4-methoxycarbonylphenyl group, 4-ethoxycarbonyl-2-chlorophenyl group, etc.); ones having a carboxy group as the substituent (e.g., 4-carboxyphenyl group, etc.); ones having a carbamoyl group at the substituent (e.g., 4-carbamoylphenyl group, 4-methylaminocarbonylphenyl group, 2-chloro-4-(N,N-diethylaminocarbonyl)phenyl group, etc.); ones having a substituted amino group (the substituent being alkyl group, aralkyl group, phenyl group, carbonic acid or acyl group induced from sulfonic acid, each of these substituents may have been further substituted) as the substituent (e.g., 4-methylaminophenyl group, 4-(N,N-diethylamino)phenyl group, 4-(N-ethyl-N-benzylamino)phenyl group, 4-acetamidophenyl group, 4-methanesulfonylaminophenyl group, 3-phenylsulfonylaminophenyl group); ones having a nitro group as the substituent (e.g., 4-nitrophenyl group, 4-nitro-2-methylphenyl group, 2-chloro-4-nitrophenyl group, etc.); ones having a cyano group as the substituent (e.g., 4-cyanophenyl group, etc.); ones having an acyl group as the substituent (e.g., 4-acetylphenyl group, 2-methyl-4-acetylphenyl group, 4-benzoylphenyl group, etc.); ones having a sulfonyl group as the substituent (e.g., 4-methanesulfonyl group, 2-chloro-4-ethanesulfonylphenyl group, 4-phenylsulfonylphenyl group, 3-(2,5-dihydroxy-4-tert-pentylphenyl)sulfonylphenyl group, etc.); ones having a sulfamoyl group as the substituent (e.g., 3-sulfamoylphenyl group, 3-(n-butylaminosulfonyl)phenyl group, 2-chloro-4-phenylaminosulfonylphenyl group, etc.); ones having a sulfo group as the substituent (e.g., 4-sulfophenyl group, 2-chloro-5-sulfophenyl group, etc.), etc.}.

It is preferred that R does not contain a dye residue or a precursor thereof, since the hydroquinone derivatives should not trap dyes and form a dye image in the interlayer.

In the molecules shown by formulae (I) to (VI), the total carbon number of $X_1$, $X_2$, $X_3$ and R is preferably more than 10, more preferably 12 to 40 for rendering the compounds non-diffusible.

Practical examples of the compounds shown by general formulae (I) to (VI) are illustrated below:

(1)
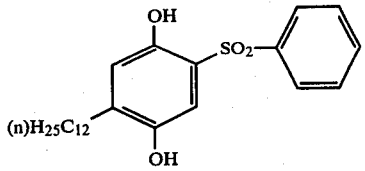
(2)
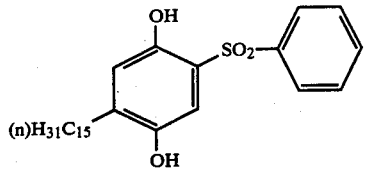
(3)
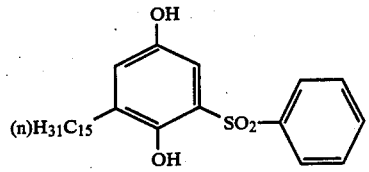
(4)
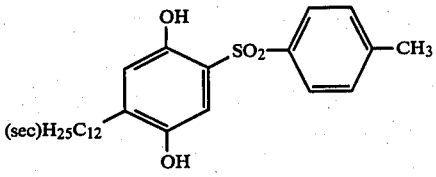
(5)
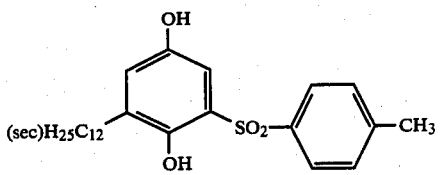
(6)
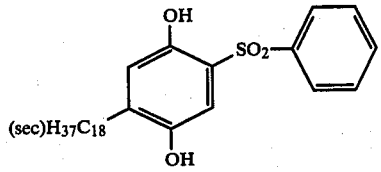
(7)
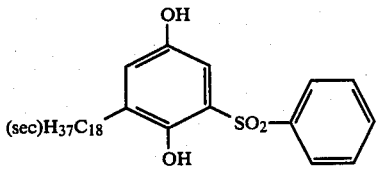
(8)
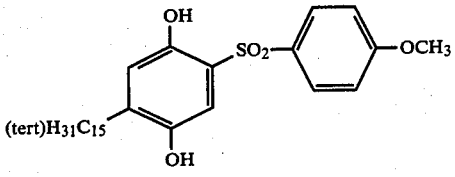
(9)
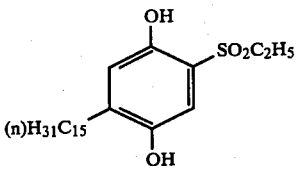
-continued
(10)
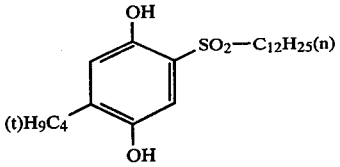
(11)
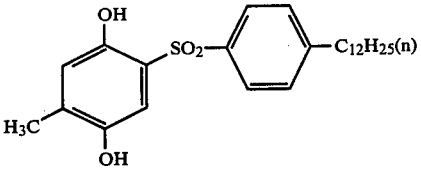
(12)
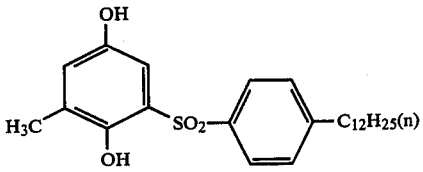
(13)
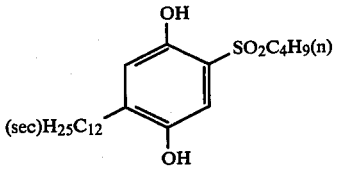
(14)
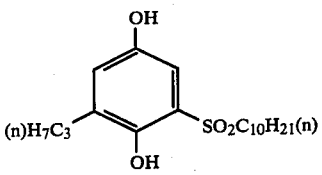
(15)
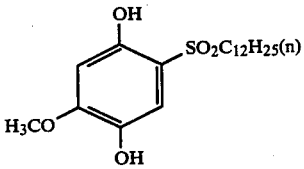
(16)
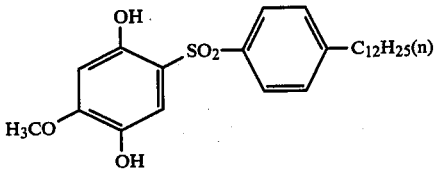
(17)
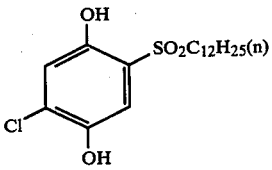
(18)
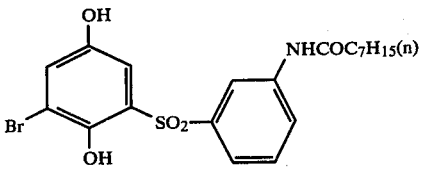

-continued (19)

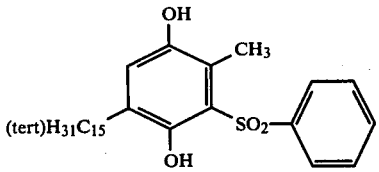

(20)

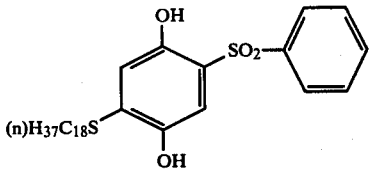

(21)

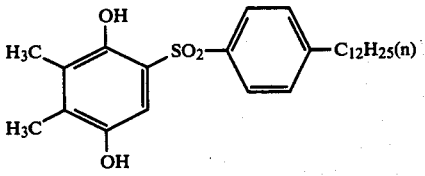

(22)

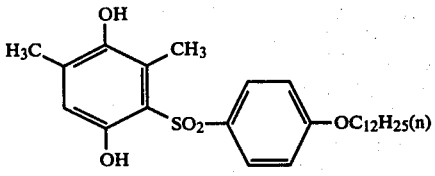

(23)

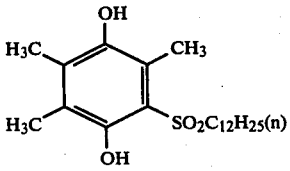

(24)

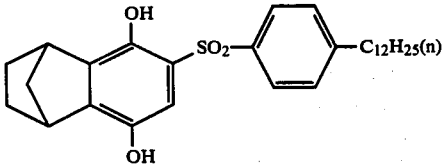

(25)

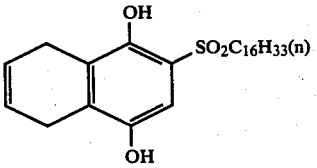

(26)

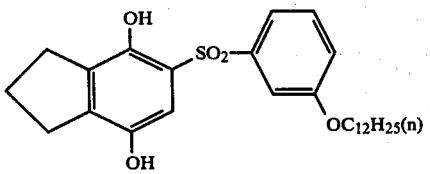

(27)

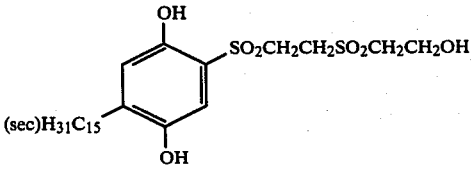

-continued (28)

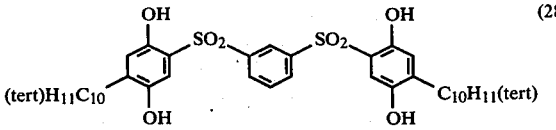

(29)

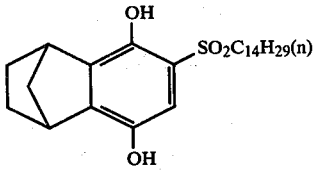

(30)

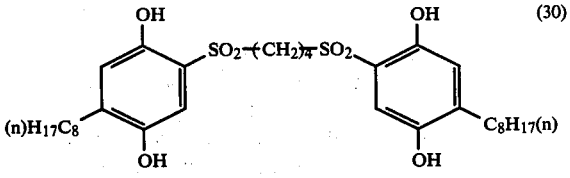

(31)

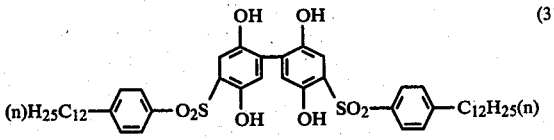

(32)

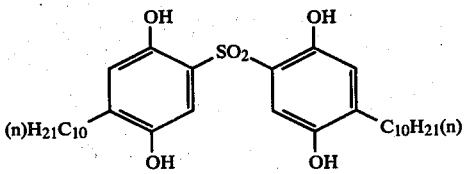

(33)

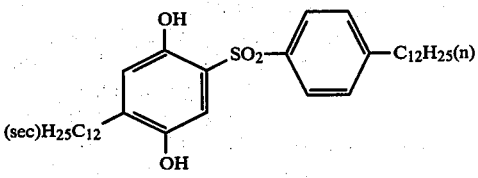

| | |
|---|---|
| 2,5-di-t-pentadecylhydroquinone | (34) |
| 2,6-di-t-pentadecylhydroquinone | (35) |
| 2,5-di-sec-dodecylhydroquinone | (36) |
| 2,6-di-sec-dodecylhydroquinone | (37) |

These hydroquinone derivatives described above are all non-diffusible and insoluble in alkali. While the hydroquinone derivatives per se are in a oily liquid state, an unexpected interaction is caused between the hydroquinone derivatives and the polymers, as will be described below, to form combined particles of the two components. It is believed that the combined particles exist in the form of solid complexes which maintain the hydroquinone derivatives in a complexed state even when the solid complexes are brought into contact with an alkaline processing solution. The solid complexes are thus kept immobilized. As a result, no exudation problem is encountered so that any undesirable trap with hydroquinones which occurred in the prior art does not occur in this invention. Therefore, formation of dye images can be very effectively performed, resulting in extremely high maximum dye image density compared with the prior art systems.

Of the compounds shown above, compounds which fall in Formulae (IV) to (VI) are basically preferred due to easy accessability (easy preparation). More preferred are Compounds (33) to (35).

The preferred mixture hydroquinone derivatives used in this invention has a solidifying point below 80° C. A mixture of hydroquinone derivatives which is in a liquid or waxy state at room temperature is particularly preferred.

Polymers which can be employed in this invention are water-insoluble organic soluble and contain a recurring unit of

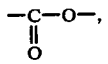

and are free of nitrogen atoms constituting the polymer at positions adjacent to the carbonyl group of the recurring unit.

Typical examples of the polymers used in this invention are shown below although the polymers used in this invention are not limited to those materials.

(A) Homopolymers and copolymers each having the recurring unit shown by the following formula

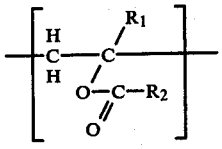

wherein $R_1$ represents hydrogen atom or an alkyl group (including a substituted alkyl group) and $R_2$ represents an alkyl group (including a substituted alkyl group) or an aryl group (including a substituted aryl group).

As the substituent of the substituted alkyl groups shown by $R_1$ and $R_2$, there are halogen atom, an alkoxy group, an aryl group, an acyl group, a cyano group, an amino group, etc. Also, as the substituent of the substituted aryl groups shown by $R_2$, there are an alkyl group, a halogen atom, an alkoxy group, etc. The preferred example of the alkyl group shown by $R_1$ is a methyl group.

These polymers are prepared using proper vinyl monomers and examples of these vinyl monomers are vinyl acetate, vinyl propionate, vinyl butyrate, vinyl isobutyrate, vinyl caproate, vinyl chloroacetate, vinyl methoxyacetate, vinyl phenylacetate, vinyl acetoacetate, vinyl lactate, vinyl benzoate, vinyl chlorobenzoate, vinyl naphthoate, etc.

Examples of proper comonomers which can be copolymerized with the above-described monomers are acrylonitrile, methacrylonitrile, styrene, α-methylstyrene, vinyl chloride, vinylidene chloride, methyl vinyl ketone, fumaric acid ester, maleic acid ester, itaconic acid ester, α-chloroethylvinyl ether, methylenemalonitrile, acrylic acid, methacrylic acid, dimethylaminoethyl methacrylate, butadiene, isoprene, vinylidene, etc.

Practical examples of the aforesaid homopolymer and copolymer are as follows:

(1) polyvinyl acetate
(2) polyvinyl propionate
(3) vinyl acetate-vinyl alcohol copolymer (90:10)

(B) Homopolymers and copolymers each having the recurring unit shown by the following formula

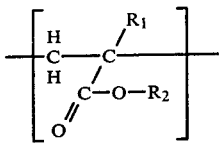

wherein $R_1$ and $R_2$ have the same significance as described in (A).

Examples of proper vinyl monomers used for preparing these polymers are methyl acrylate, ethyl acrylate, n-propyl acrylate, isopropyl acrylate, n-butyl acrylate, octyl acrylate, 2-chloroethyl acrylate, 2-cyanoethyl acrylate, N-(β-dimethylaminoethyl) acrylate, benzyl acrylate, cyclohexyl acrylate, phenyl acrylate, methyl methacrylate, ethyl methacrylate, n-propyl methacrylate, isopropyl methacrylate, n-butyl methacrylate, octyl methacrylate, cyclohexyl methacrylate, benzyl methacrylate, etc. Examples of proper comonomers which can be copolymerized with these monomers are the vinyl monomers illustrated in (A).

Practical examples of the homopolymers and copolymers are as follows:

(4) polymethyl methacrylate
(5) polyethyl acrylate
(6) polyethyl methacrylate
(7) polybutyl acrylate
(8) polybutyl methacrylate
(9) polyisobutyl methacrylate
(10) polyisopropyl methacrylate
(11) polyoctyl acrylate
(12) butyl acrylate-acrylamide copolymer (95:5)
(13) stearyl methacrylate-acrylic acid copolymer (90:10)

(C) Polyester resins obtained by the condensation of polyhydric alcohols and polybasic acids.

Examples of the effective polyhydric alcohols are the glycols having the structure HO—$R^3$—OH (wherein $R^3$ represents a hydrocarbon chain, in particular, an aliphatic hydrocarbon chain of 2 to about 12 carbon atoms) and polyalkylene glycols and examples of the effective polybasic acids are those having the structure HOOC—$(R^4)_p$—COOH (wherein p is 0 or 1 and when p is 1, $R^4$ represents a hydrocarbon chain of 1 to about 12 carbon atoms).

Practical examples of the polyhydric alcohols are ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,4-pentanediol, glycerol, diglycerol, triglycerol, 1-methylglycerol, erithrite, mannitol, sorbitol, etc.

Practical examples of the polybasic acids are oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, metaconic acid, isopimelic acid, cyclopentadiene-maleic anhydride adduct, rosin-maleic anhydride adduct, etc.

Practical examples of the polyester resins are as follows:

(14) 1,4-butanediol-adipic acid polyester

(15) ethylene glycol-sebacic acid polyester (D) Others;

For example, the polyesters obtained by the following ring opening-polymerization:

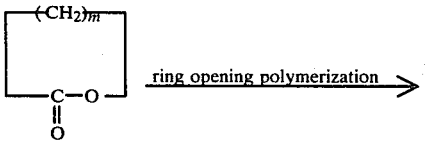

polyester having the following recurring unit

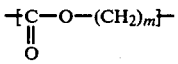

wherein m represents an integer of 4 to 7 and the chain $—CH_2—$ may be a branched one.

Proper monomers used for preparing these polyesters are β-propiolactone, ε-caprolactone, dimethylpropiolactone, etc.

Practical examples of the polyesters are as follows:

(16) polycaprolactone

(17) polypropiolactone

(18) polydimethylpropiolactone

The amount of the polymer used in this invention depends upon the using purpose but is usually 5 to 90% by weight to the hydrophilic binder contained in the interlayer.

Examples of the hydrophilic binder for dispersing therein the mixture of the hydroquinone derivatives used in this invention are proteins such as gelatin, a gelatin derivative modified by an acylating agent, etc., gelatin grafted by a vinyl polymer, casein, albumin, etc.; cellulose derivatives such as hydroxyethyl cellulose, hydroxypropyl cellulose, carboxymethyl cellulose, methyl cellulose, etc.; high-molecular nonelectrolytes such as polyvinyl alcohol, polyacrylamide, polyvinyl ethers (e.g., polymethylvinyl ether), etc.; and anionic synthetic polymers such as polyacrylic acid, partially hydrolyzed products of polyacrylamide, etc. These hydrophilic binders may be used solely or as a mixture.

When preparing the dispersion of a mixture of the hydroquinone derivative mixture and the polymer, it is desirable to dissolve a hydroquinone derivative mixture and a relatively hydrophilic, water-insoluble polymer of this invention in a volatile organic solvent (e.g., ethyl acetate which does not mix readily with water). The solution is then emulsified in a sol of a hydrophilic binder such as gelatin. An emulsion is obtained wherein droplets containing the hydroquinone derivative mixture and the polymer dissolved in the volatile solvent have been finely dispersed in an aqueous phase. The emulsified dispersion (or composition) is solidified by, for example, cooling. After cutting the solidified composition into noodle-like pieces, the solvent is substantially wholly removed from the solidified composition by evaporation at room temperature or by washing. By the procedures described above, an emulsion containing separate particles of the combined composition of the hydroquinone derivative mixture and the polymer dispersed substantially uniformly in a hydrophilic colloid binder is obtained. It is proper that the mean size of the particles be in a range of about 0.1 to 2 microns.

The interlayer composed of the hydroquinone derivative mixture and the polymer of this invention is formed by coating the emulsified dispersion obtained by the aforesaid step on a photographic layer and drying. When both components described above are dissolved in a low-boiling solvent, a proper amount (e.g., 10–14% by weight) of a water-soluble low-boiling solvent (e.g., methanol, etc.) may be used together with the aforesaid low-boiling solvent. Surface active agents used for dispersing a dye image-providing compound by emulsification that can be effectively employed are the same as those for lreparing the emulsified dispersion described above.

It is preferred when forming the interlayer of this invention not to use an oil (it is a water-insoluble high boiling organic solvent and the content thereof in a photographic layer does not substantially change before or after coating the coating composition for the photographic layer) as the solvent.

Japanese Patent Application (OPI) No. 41633/72 shows that a complex is formed from a hydroquinone derivative and a polymer having a strong hydrogen bond-forming faculty, such as polyvinyl pyrrolidone, etc. However, improved unexpected results are obtained when a liquid mixture of hydroquinone derivatives which has been art-recognized to have a poor hydrogen bond-forming faculty and to thus be solidified only with extreme difficulty, is immobilized by interaction with a polymer according to this invention. Due to the water-insolubility required for the polymer used in this invention, it is believed that the immobilized state would be stably maintained in a hydrophilic binder forming an interlayer. Further, the polymer used in this invention has no nitrogen at a position adjacent to the carbonyl group of the recurring unit; as a result, transfer of dye images is not adversely affected, which results in improved $D_{max}$. These effects are contrasted to the system using a water-soluble polymer containing

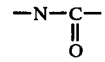

wherein transfer of dye images is inhibited due to a mordanting effect of the water-soluble polymer (such as polyvinyl pyrrolidone).

The silver halide emulsion used in this invention is a hydrophilic colloidal dispersion of silver chloride, silver bromide, silver chlorobromide, silver iodobromide, silver chloroiodobromide or a mixture of them. The halogen composition thereof is selected according to the purpose of and the processing condition for photographic materials but is preferably silver bromide, silver iodobromide or silver chloroiodobromide containing less than 10 mol% iodide and less than 30 mol% chloride.

Examples of the internal latent image type silver halide emulsions used in this invention include conversion type silver halide emulsions, core/shell type silver halide emulsions, and silver halide emulsions containing different kinds of metal as described in U.S. Pat. Nos. 2,592,250, 3,206,313, 2,447,927, 3,761,276 and 3,935,014.

Examples of the nucleating agents for the silver halide emulsions of this type include hydrazines described in U.S. Pat. Nos. 2,588,982 and 2,563,785; the hydrazides and hydrazones described in U.S. Pat. No.

3,227,552; the quaternary salt compounds described in British Pat. No. 1,283,835, Japanese Patent Publication No. 38164/74, and U.S. Pat. Nos. 3,734,738, 3,719,494 and 3,615,615; the sensitizing dyes having a nucleating substituent having a fogging action in the dye molecule as described in U.S. Pat. No. 3,718,470; and the acylhydrazinophenylthiourea compounds described in U.S. Pat. Nos. 4,030,925 and 4,031,127.

The silver halide emulsions used in this invention can have, if desired, an enlarged color sensitivity by the action of spectral sensitizing dyes. Examples of spectral sensitizing dyes include cyanine dyes and merocyanine dyes.

As dye image-providing compounds, various compounds can be utilized in this invention but couplers and dye releasing redox compounds are particularly useful.

Among the dye releasing redox compounds, the compounds which cause alkali hydrolysis when the compounds are oxidized to release dyes are described in the following patents and patent applications: U.S. Pat. Nos. 4,053,312, 4,055,428, 4,076,529, 4,152,153, and 4,135,929, Japanese Patent Application (OPI) Nos. 149328/78, 104343/76, 46730/78, 130122/79 and 3819/78 and Japanese Patent Application Nos. 89128/79, 90806/79 and 91187/79 (West German Pat. No. (OLS) 3,027,291).

Among these compounds, the dye releasing redox compounds which release yellow dyes are described in, for example, U.S. Pat. No. 4,013,633, Japanese Patent Application (OPI) Nos. 149328/78 and 114930/76, Japanese Patent Application No. 148237/79 (West German Pat. No. (OLS) 3,027,291) and *Research Disclosure,* 17630 (1978), and ibid., 16475 (1977).

The dye releasing redox compounds which release magenta dyes are described in, for example, U.S. Pat. Nos. 3,954,476, 3,931,144 and 3,932,308, Japanese Patent Application (OPI) Nos. 23628/78, 106727/77, 36804/80, 134850/80 and 65034/79, Japanese Patent Application Nos. 69488/78 (West German Pat. No. (OLS) 2,923,300), 76162/78 (West German Pat. No. (OLS) 2,925,279), 149777/79 (West German Pat. No. (OLS) 3,027,291) and 146655/79 (West German Pat. No. (OLS) 3,027,291), and West German Pat. No. (OLS) 2,847,371.

The dye releasing redox compounds which release cyan dyes are described in U.S. Pat. Nos. 3,942,987, 3,929,760 and 4,013,635, Japanese Patent Application (OPI) Nos. 109928/76, 149328/78, 8827/77, 143323/78 and 47823/78 and Japanese Patent Application No. 146654/79 (West German Pat. No. (OLS) 3,027,291).

Redox compounds of the type that the unoxidized compounds release dyes by causing ring closure, etc., are described in, for example, U.S. Pat. Nos. 4,139,379 and 3,980,479 and West German Pat. Nos. (OLS) 2,402,900 and 2,448,811.

At the practice of this invention, the dye releasing redox compounds shown by the following general formula are preferably used:

Y—X wherein Y represents a redox nucleus (carrier) and Y represents a dye residue or a dye precursor bonded to aforesaid Y directly or through an interposed group L.

L represents an interposed group such as an alkylene group (or alkylidene group) having 1 to 6 carbon atoms, an arylene group, or a heterocyclic group. The interposed group L may be bonded to aforesaid X directly or through —O—, —S—, —$SO_2$—, $NR_o$— (wherein $R_o$ represents hydrogen atom or an alkyl group), —CO—, —CO—NH— or —$SO_2$—NH—.

The above-mentioned dye residue may be principally the residue of any desired kind of dye. The dye residue, however, must have a sufficient diffusibility for reaching an image-receiving layer passing through silver halide emulsion layers in a photographic material. For this purpose, one or more water solubility providing groups may be boned to the dye residue. Proper examples of such a water solubility providing group are a carboxy group, sulfo group, sulfonamido group, sulfamoyl group, aliphatic or aromatic hydroxy group, etc.

Examples of the dyes particularly suitable for this invention are azo dyes, azomethine dyes, anthraquinone dyes, phthalocyanine dyes, indigoid dyes, triphenylmethane dyes, metal complex dyes, and colored metal complexes.

The above-described dye precursor residue is the residue of a compound which can be converted into a dye by the liberation of an auxochrome (i.e., the addition of the auxochrome by liberation to chromophore) in a coloring system by oxidation in a conventional processing step or an additional processing step of photographic processing steps. In this case the dye precursor may be a leuco dye or may be a dye which is converted into other dye during photographic processing.

An effective example for the redox compounds is an N-substituted sulfamoyl group. For example, the groups shown by following formula (A) are illustrated as Y:

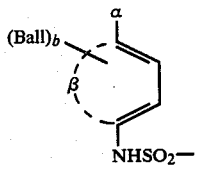

(A)

wherein β represents a non-metallic atomic group necessary for forming a benzene ring and the benzene ring may form, for example, a naphthalene ring, a quinoline ring, a 5,6,7,8-tetrahydronaphthalene ring, chroman ring, etc., by the condensation with a carbon ring or a heterocyclic ring. Furthermore, the aforesaid benzene ring or the ring formed by the condensation of a carbon ring or a heterocyclic ring to the benzene ring may have a substituent such as halogen atom, alkyl group, alkoxy group, aryl group, aryloxy group, nitro group, amino group, alkylamino group, arylamino group, amido group, cyano group, alkylmercapto group, keto group, carboalkoxy group, heterocyclic group, etc.

In formula (A) described above, α represents a group shown by —$OG^1$ or —$NHG^2$, wherein $G^1$ represents hydrogen atom or a group which forms a hydroxy group by the hydrolysis thereof, preferably the group shown by $$-\overset{O}{\overset{\|}{C}}G^3 \text{ or } -\overset{O}{\overset{\|}{C}}-O-G^3$$

(wherein $G^3$ represents an alkyl group, in particular, an alkyl group of 1 to 18 carbon atoms, such as methyl group, ethyl group, propyl group, etc.; a halogen-substituted alkyl group of 1 to 18 carbon atoms, such as chloromethyl group, trifluoromethyl group, etc.; a phenyl group; a substituted phenyl group; etc.; and $G^2$ represents hydrogen atom, an alkyl group of 1 to 22 carbon atoms, or a hydrolyzable group). Preferred examples of the hydrolyzable groups shown by $G^2$ described above are the group shown by $$-\overset{\overset{\displaystyle O}{\|}}{C}G^4,$$

$-SO_2G^5$ or $-SOG^5$ (wherein $G^4$ represents an alkyl group of 1 to 4 carbon atoms, such as methyl group, etc.; a halogen-substituted alkyl group such as mono-, di or trichloromethyl group, trifluoromethyl group, etc.; an alkylcarbonyl group such as acetyl group, etc.; an alkyloxy group; a substituted phenyl group such as nitrophenyl group, cyanophenyl group, etc.; an unsubstituted phenyloxy group or a phenyloxy group substituted by lower alkyl group or halogen atom; a carboxyl group; an alkyloxycarbonyl group; an aryloxycarbonyl group; an alkylsulfonylethoxy group; or an arylsulfonylethoxy group and $G^5$ represents a substituted or unsubstituted alkyl or aryl group.

Furthermore, in aforesaid formula (A), b is an integer of 0, 1 or 2. However, except the case that $-NHG^2$ shown by $\alpha$ has introduced thereto as $G^2$ a group corresponding to an alkyl group which makes the compound shown by general formula (A) immobile and non-diffusible, i.e., when $\alpha$ is the group shown by $-OG^1$ and when $\alpha$ is shown by $-NHG^2$ and $G^2$ is hydrogen atom, an alkyl group of 1 to 8 carbon atoms, or a hydrolyzable group, b is 1 or 2, preferably 1.

In formula (A), Ball represents a group which makes the compound non-diffusible.

Practical examples of Y described above are described in Japanese Patent Application (OPI) Nos. 33826/73, 50736/78, 54021/79 and 143230/79.

Another example of Y suitable for the compounds of this type is the group shown by following formula (B)

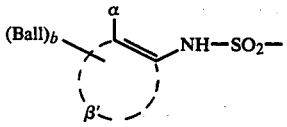

(B)

wherein Ball, $\alpha$, b have the same significance as in formula (A) and $\beta'$ represents an atomic group necessary for forming a carbon ring such as a benzene ring. The benzene ring may form a naphthalene ring, a quinoline ring, a 5,6,7,8-tetrahydronaphthalene ring, a chroman ring, etc., by the condensation with a carbon ring or a heterocyclic ring. Furthermore, each of the above-described various rings may have a substituent such as halogen atom, alkyl group, alkoxy group, aryl group, aryloxy group, nitro group, amino group, alkylamino group, arylamino group, amido group, cyano group, alkylmercapto group, keto group, carboalkoxy group, heterocyclic group, etc.

Practical examples of Y of this type are described in Japanese Patent Application (OPI) Nos. 113624/76, 149328/78, 65034/79 and 111344/79, Japanese Patent Application No. 91187/79 (West German Pat. No. (OLS) 3,027,291), and U.S. Pat. No. 4,053,312.

Also, the couplers used in this invention are described in, for example, *The Theory of Photographic Process*, 4th Edition, edited by T. H. James, 1977, Chapter 12.

Now, the invention is explained by referring to the case of using redox compounds but it can be applied to the case of using other dye image-providing compounds.

The coverage of the dye releasing redox compound is $1\times10^{-4}$ to $1\times10^{-2}$ mol/m$^2$, preferably $2\times10^{-4}$ to $2\times10^{-3}$ mol/m$^2$.

The dye releasing redox compound used in this invention can be dispersed in a hydrophilic colloid as a carrier by various manners according to the type of the compound. For example, the compound having a dissociative group such as sulfo group and carboxy group can be dispersed in a hydrophilic colloid solution as a solution in water or an alkaline aqueous solution. On the other hand, the compound, which is sparingly soluble in an aqueous medium but is easily soluble in an organic solvent, can be dispersed by the following manner:

(1) The compound is dissolved in a substantially water-insoluble high-boiling solvent and then the solution formed is dispersed in a hydrophilic colloid solution. Such a method is described in, for example, U.S. Pat. Nos. 2,322,027, 2,533,514 and 2,801,171. Also, if necessary, a low-boiling solvent or an organic solvent readily soluble in water may be used in the aforesaid method and such a solvent is removed by volatilization under drying or by water washing.

(2) The compound is dissolved in a water-miscible solvent and then the solution is dispersed in a hydrophilic colloid solution.

(3) In method (1) described above an oleophilic polymer is used together with the high-boiling solvent. Such a method is described in, for example, U.S. Pat. No. 3,619,195 and German Pat. No. (DAS) 1,957,467.

(4) The compound is dissolved in a water-miscible solvent and the solution is gradually added to an aqueous latex to provide dispersion wherein the compound is incorporated in the latex particles. This method is described in, for example, Japanese Patent Application (OPI) No. 59943/76.

Moreover, a hydrosol of an oleophilic polymer described in Japanese Patent Publication No. 39835/76 may be added to the hydrophilic colloid dispersion obtained by the above-described method.

The dispersion of the dye releasing redox compound is greatly promoted by using a surface active agent as an emulsifier. Examples of the useful surface active agent are described in, for example, the above-mention patent specifications and Japanese Patent Publication No. 4923/64 and U.S. Pat. No. 3,676,141.

Examples of the hydrophilic colloids used for dispersing the dye releasing redox compounds used in this invention are, for example, gelatin, colloidal albumin, casein, cellulose derivatives such as carboxymethyl cellulose, hydroxyethyl cellulose, etc., sugar derivatives such as agar, sodium alginate, starch derivatives, etc., and synthetic hydrophilic colloids such as polyvinyl alcohol, poly-N-vinylpyrrolidone, polyacrylic acid copolymer, polyacrylamide, and the derivatives thereof (e.g., partially hydrolyzed products). If necessary, these colloids may be used as two or more miscible mixtures. Among the aforesaid materials, gelatin is most generally used and gelatin may be partially or wholly replaced with a synthetic hydrophilic colloid.

Examples of the dye releasing redox compound having a dye constituting residue including a readily reducible group at the dye moiety are described in Japanese Patent Application (OPI) Nos. 126331/74, 109928/76 and 99431/79.

A process for obtaining color diffusion transfer images using dye releasing redox compounds is described in *Photographic Science and Engineering,* Vol. 20, No. 4, July/August, 155–164 (1976).

In the above-described process any silver halide developing agent which can cross oxidize the dye releasing redox compounds can be used. Such a developing agent may be incorporated in an alkaline processing composition or in a proper layer of a photographic element. Examples of the developing agents used in this invention are the hydroquinones, aminophenols, and pyrazolidinones (e.g., phenidone, 1-phenyl-3-pyrazolidinone, dimeson(1-phenyl-4,4-dimethyl-3-pyrazolidinone), 1-p-tolyl-4-methyl-4-oxymethyl-3-pyrazolidinone, 1-(4'-methoxyphenyl)-4-methyl-4-oxymethyl-3-pyrazolidinone, and 1-phenyl-4-methyl-4-oxymethyl-3-pyrazolidinone) as described in Japanese Patent Application No. 91187/79 (West German Pat. No. (OLS) 3,027,291).

Among these color developing agents such as phenylenediamines, black-and-white developing agents (in particular, pyrazolidinones), those which are capable of reducing the formation of stains in the image-receiving layer are particularly preferred.

The processing composition used in this invention contains a base such as sodium hydroxide, potassium hydroxide, sodium carbonate, sodium phosphate, etc., and has a pH higher than 9, preferably higher than 11.5. The processing composition contains an antioxidant such as sodium sulfite, ascorbate, piperidinohexose reductone, etc., and may contain a silver ion concentration controlling agent such as potassium bromide. The processing composition may further contain a viscosity increasing material such as hydroxyethyl cellulose, sodium carboxymethyl cellulose, etc.

The alkaline processing composition used in this invention may also contain a development accelerating compound or a compound for accelerating the diffusion of dyes (e.g., benzyl alcohol, etc.).

The photosensitive element to which the invention is applicable is composed of combinations of silver halide emulsions and dye image-providing materials. A combination of the color sensitivity of a silver halide emulsion and the spectral absorption of a dye image is properly selected according to the desired color reproduction. For the reproduction of natural color by a subtractive color process, a photosensitive element has at least two combinations. The combinations are of a silver halide emulsion having a selective color sensitivity in a certain wavelength region and a compound providing a dye image having a selective spectral absorption in the same wavelength region. Particular combinationas which make up useful photosensitive elements are comprising of: a blue-sensitive silver halide emulsion and a yellow dye-releasing redox compound; a green-sensitive silver halide emulsion and a magenta dye-releasing redox compound; and a red-sensitive silver halide emulsion and a cyan dye-releasing redox compound. These combination units of the silver halide emulsions and the dye-releasing redox compounds may be coated as laminated layers in a face-to-face relationship in the photosensitive element or may be coated as one layer of a mixture of the particles (a dye-releasing redox compound and a silver halide grain existing in the same particle).

A spacing layer may be formed between the interlayer and the layer containing the dye image-providing material as described in Japanese Patent Application No. 125600/78 (West German Pat. No. (OLS) 2,941,427). Also, the interlayer may contain a silver halide emulsion as described in Japanese Patent Application No. 144155/79 (corresponding to U.S. patent application Ser. No. 204,667 (filed Nov. 6, 1980)).

The dyeing layers, neutralizing layers, neutralization speed controlling layer (timing layer), and processing compositions used for the photographic materials of the color diffusion transfer process of this invention are described in Japanese Patent Application No. 64533/77 (West German Pat. No. (OLS) 2,823,903).

It is preferred that the photosensitive material for the color diffusion transfer process of this invention is a mono-sheet type film unit throughout before, during, and after the image-exposure thereof (e.g., a combination of a photosensitive element, an image-receiving element, and a processing element) which can be developed in a bright place. Such film units are described in *Photographic Science and Engineering,* described above, Nebletts's *Handbook of Photography and Reprography Materials, Process and Systems,* 7th Ed., Chapter 12 (1977).

The color photographic materials of this invention can be used for a color diffusion transfer process as well as a conventional color photographic process.

The invention will be explained in more detail by the following examples.

EXAMPLE 1

On a polyethylene terephthalate support was coated a white reflection layer containing titanium dioxide and gelatin at coverages of 44 g/m$^2$ and 4.4 g/m$^2$ respectively and then coating composition No. 1 or No. 2 prepared by the following manner was coated thereon and dried to provide Samples No. 1 and No. 2.

Samples No. 1 and No. 2 thus prepared were preserved for 7 days under natural conditions (Condition A) and for 3 days under severe condition of 60° C. and 80% RH (Condition B) and then the states of the surfaces of the samples and the coloring (yellow) extents were compared.

Emulsification of Coating Composition No. 1

A solution of 40 g of a mixture of 2,5-di-t-pentadecylhydroquinone isomers in 50 ml of ethyl acetate was dispersed in 600 g of an aqueous gelatin solution containing 10% gelatin using sodium dodecylbenzenesulfonate as a dispersing agent.

Emulsification of Coating Composition No. 2

A solution of 40 g of a mixture of the isomers of 2,5-di-t-pentadecylhydroquinone and 20 g of a vinyl acetate polymer in 50 ml of ethyl acetate was dispersed in 600 g of an aqueous gelatin solution containing 10% gelatin using sodium dodecylbenzenesulfonate. The dispersion was solidified under cooling, the solidified composition was cut into noodles, and they were washed to remove substantially all solvent.

Composition of Coating Composition No. 1

Gelatin (1.5 g/m$^2$) and a 2,5-di-t-pentadecylhydroquinone eutectic isomer mixture (1.0 g/m$^2$).

Composition of Coating Composition No. 2

Gelatin (1.5 g/m$^2$), a 2,5-di-t-pentadecylhydroquinone eutectic isomer mixture (1.0 g/m$^2$), and a vinyl acetate polymer (0.5 g/m$^2$).

The results are shown in the following table.

TABLE 1

| Sample | Colored Extent (color reflection density) Yellow Density Condition A | Condition B | Note |
|---|---|---|---|
| No. 1 | 0.20 | 0.35 | Comparison |
| No. 2 | 0.19 | 0.20 | This Invention |

From the results shown in Table 1, it is understood that under condition B, Sample No. 1 was greatly colored while Sample No. 2 was scarcely colored (the coloring is considered to be caused by the oxidation of the hydroquinone derivatives). Also, in sample No. 1, the coated surface became oily under condition A and the exudation of hydroquinone derivatives onto the surface thereof was accelerated under condition B. On the other hand, in Sample No. 2, the coated surface did not become oily under both conditions A and B.

EXAMPLE 2

Photographic material (I) of this invention and comparison photographic material (II) each having the construction and composition shown below were prepared. After one week, the properties were compared between those preserved for 3 days under conditions of 45° C. and 70% in RH and those preserved for 3 days under normal conditions (25° C. and 50% in RH). Each of the photographic materials was exposed through an optical wedge having a density difference of 0.2 using a tungsten light of 2,854° K. (in this case the maximum exposure amount was 10 CMS). The exposed photographic materials were developed by passing through a pair of juxtaposed press rollers.

Photographic material (I) of this invention was a sheet-like photographic unit wherein photographic element (I) prepared by successively coating a transparent polyethylene terephthalate film support with the layers shown below was fixedly laminated on the cover sheet shown below in a face-to-face relationship. A rupturable pod-like container of a viscous processing solution having the composition shown below was inserted in a body between the two elements and at the end margins of the both elements so that the alkaline viscous processing solution could be spread between the two elements.

The cover sheet was prepared by successively coating a transparent polyethylene terephthalate film support with the following layers in the order shown below:

(1) Neutralizing layer composed of polyacrylic acid (10 g/m$^2$).

(2) Timing layer composed of acetyl cellulose (10 g/m$^2$).

| Composition of the viscous processing solution: | |
|---|---|
| Water | 820 ml |
| 1N—$H_2SO_4$ | 5 ml |
| Hydroxyethyl cellulose | 60 g |
| 4-Hydroxymethyl-4-methyl-1-phenyl-3-pyrazolidone | 5 g |
| 5-Methylbenzotriazole | 2 g |
| t-Butylhydroquinone | 0.4 g |
| Sodium sulfite | 2 g |
| Carbon black | 150 g |
| Sodium hydroxide | 30 g |

Construction and composition of the photosensitive element

The photosensitive element was prepared by coating a transparent polyethylene terephthalate film support with the layer shown below.

(1) Image-receiving layer containing 4.0 g/m$^2$ of copoly[styrene-N-vinylbenzyl-N,N,N-trihexylammonium chloride] and 4.0 g/m$^2$ of gelatin.

(2) White reflecting layer containing 22 g/m$^2$ of titanium trioxide and 2.2 g/m$^2$ of gelatin.

(3) Opaque layer containing 2.7 g/m$^2$ of carbon black and 2.7 g/m$^2$ of gelatin.

(4) Layer containing 0.50 g/m$^2$ of the cyan dye-releasing redox compound having the following structure, 0.50 g/m$^2$ of N,N-diethyllaurylamide, and 1.5 g/m$^2$ of gelatin.

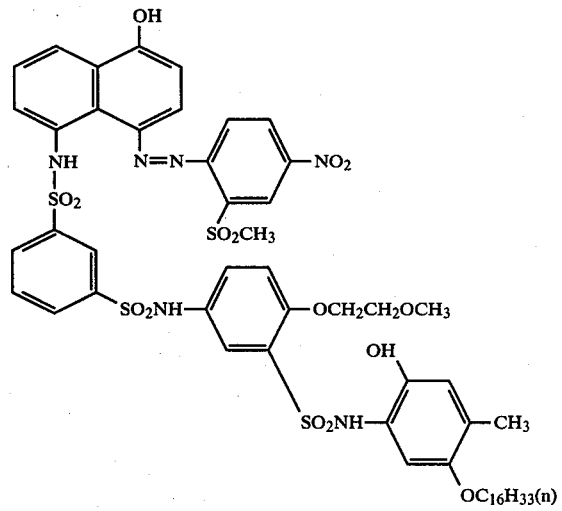

(5) Layer containing a red-sensitive internal latent image-type silver bromide emulsion (1.1 g/m$^2$ of gelatin and 1.4 g/m$^2$ of silver), 0.015 g/m$^2$ of 1-acetyl-2-[4-(2,4-di-t-pentylphenoxyacetamido)phenyl]hydrazine (nucleating agent), and 0.067 g/m$^2$ of sodium 2-pentadecylhydroquinone-5-sulfonate.

(6) Color mixing inhibitor-containing layer containing 1.0 g/m$^2$ of gelatin, 1.0 g/m$^2$ of a 2,5-di-t-pentadecylhydroquinone eutectic mixture, and 0.6 g/m$^2$ of polyvinyl acetate.

(7) Layer containing 0.80 g/m$^2$ of the magenta dye-releasing redox compound having the following structure, 0.20 g/m$^2$ of N,N-diethyllarylamide, and 1.2 g/m$^2$ of gelatin.

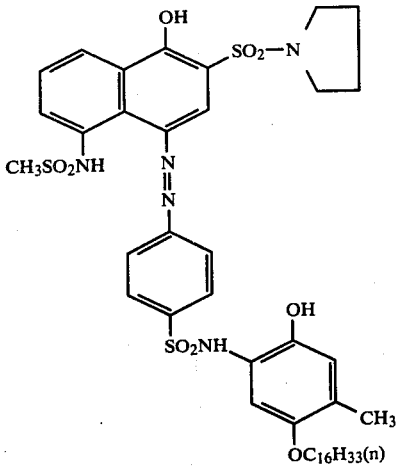

(8) Layer containing a green-sensitive internal latent image-type silver bromide emulsion (1.1 g/m$^2$ of gelatin and 1.4 g/m$^2$ of silver), 0.015 g/m$^2$ of the nucleating agent same as in the 5th layer, and 0.067 g/m$^2$ of sodium 2-pentadecylhydroquinone-5-sulfonate.

(9) Color mixing inhibitor-containing layer containing 1.0 g/m$^2$ of gelatin, 1.0 g/m$^2$ of a 2,5-di-t-pentadecylhydroquinone eutectic mixture, and 0.6 g/m$^2$ of polyvinyl acetate.

(10) Layer containing 1.0 g/m$^2$ of the yellow dye-releasing redox compound having the following structure, 0.25 g/m$^2$ of N,N-diethyllaurylamide, and 1.0 g/m$^2$ of gelatin.

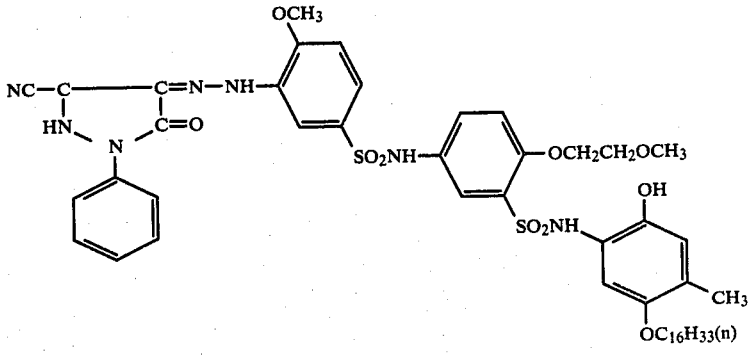

(11) Layer containing a blue-sensitive internal latent image-type silver bromide emulsion (1.1 g/m$^2$ of gelatin and 1.4 g/m$^2$ of silver), 0.015 g/m$^2$ of the nucleating agent same as in the 5th layer, and 0.067 g/m$^2$ of sodium 2-pentadecylhydroquinone-5-sulfonate.

(12) Protective layer containing 1.3 g/m$^2$ of gelatin, 0.9 g/m$^2$ of the latex of polyethyleneacryl acrylate, and 0.026 g/m$^2$ of triacryloyl perhydrotriazine as a hardening agent.

Comparison photographic material (II) was prepared by the same manner as in the case of preparing photographic material (I) of this invention except that the 6th layer and the 9th layer were replaced by the following layer (6') and layer (9'), respectively.

(6') Color mixing inhibitor-containing layer containing 1.0 g/m$^2$ of gelatin and 1.0 g/m$^2$ of a 2,5-di-t-pentadecylhydroquinone eutectic mixture.

(9') Same as the 6' layer

The results are shown in Table 2.

TABLE 2

| | Reflection Density (a) | | Reflection Density (b) | |
|---|---|---|---|---|
| | Maximum Density | Minimum Density | Maximum Density | Minimum Density |
| Photographic Material (I) | | | | |
| Yellow Density | 1.82 | 0.26 | 1.75 | 0.26 |
| Magenta Density | 2.02 | 0.26 | 2.00 | 0.26 |
| Cyan Density | 1.90 | 0.29 | 1.88 | 0.29 |
| Comparison Photographic Material (II) | | | | |
| Yellow Density | 1.78 | 0.26 | 1.64 | 0.26 |
| Magenta Density | 1.85 | 0.26 | 1.40 | 0.26 |
| Cyan Density | 1.75 | 0.30 | 1.51 | 0.29 |

Reflection Density (a):
The density one hour after processing the photographic material preserved for 3 days in room (at 25° C. and 60% in RH)
Reflection Density (b):
The density one hour after processing the photographic material preserved for 3 days at 45° C. and 70% in RH.

As is clear from the results of Table 2, the photographic material (I) of this invention has high maximum densities of the yellow, magenta and cyan transferred images obtained under the preserved conditions and is stable. In comparison photographic material (II) has the low maximum density as compared with that of the photographic material (I). In particular, under severe preservative conditions, the maximum density of the transferred images is greatly reduced and thus unstable.

Also, when the cross sections of photographic elements (I) and (II) preserved for 3 days at a temperature of 45° C. and a relative humidity of 70% were observed, the boundary surfaces between the color mixing inhibiting layer and the dye image-providing compound-containing layer was clearly observed in photographic element (I). However, the boundry surface between the layers was indistinct in photographic element (II). Furthermore, it has been confirmed that there was a transfer of the color mixing inhibitor used into the dye image-providing compound-containing layer and a transfer of the dye image-providing layer into the color mixing inhibiting layer.

EXAMPLE 3

Adhesive strength test between the interlayer and the coloring material layer:

The peeling strength which was the degree of the adhesive strength between the layers was measured and the results were compared between the case of using the polymer used in the invention photographic element (I) described in Example 2 and the case of using no such polymer (photographic element (II)). Samples preserved for 7 days under normal conditions (25° C. and 60% in RH) and samples preserved for 3 days under severe conditions (60° C. and 80% in RH) were used.

In the peeling test, the following conditions were employed.

Test machine: Instron Tensile Testing Machine (peeling test machine)

Tensile speed: 300 mm/min
Peeling angle: 180°
Peeling width: 20 mm
Environmental condition: 25° C. and 60% in RH (the samples were measured after allowing them to stand under these conditions for longer than 2 hours).

The results are shown in the following table.

TABLE 3

| | Results of Peeling Test*(3) | |
|---|---|---|
| | Preserved Condition (A) | Preserved Condition (B) |
| Photographic Element (I) | 2.5 kg/20 mm*(1) | 2.5 kg/20 mm*(2) |
| Photographic Element (II) | 1.6 kg/20 mm | 0.2 kg/20 mm |

*(1)No peeling occurred in the photographic element but peeling between the photographic element and an adhesive tape occurred.
*(2)Same as above.
*(3)The mean value of four tests in each case.

As shown in Table 3, under the test conditions, no peeling occurred in the photographic element and the adhesion between layers was strong in photographic element (I), while peeling occurred easily between layers in photographic element (II). When the cross section of photographic element (II), after test, was observed by microscope, peeling was observed between the color mixing inhibiting layer and the layer containing the dye-releasing redox compound.

EXAMPLE 4

Photographic materials (A) to (C) were prepared by coating successively onto a transparent polyester support the following layers.

Photographic material (A) (for comparison)

(1) Dyeing layer same as in Example 2.

(2) White reflecting layer same as in Example 2.

(3) Opaque layer as in Example 2.

(4) Layer containing 0.21 g/m$^2$ of the magenta dye-releasing redox compound having following formula I, 0.11 g/m$^2$ of the magenta dye-releasing redox compound having following formula II, 0.08 g/m$^2$ of tricyclohexyl phosphate, 0.009 g/m$^2$ of 2,5-di-t-pentadecylhydroquinone, and 0.9 g/m$^2$ of gelatin.

Formula I

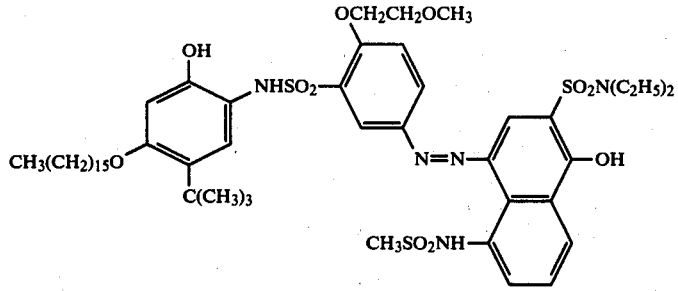

Formula II

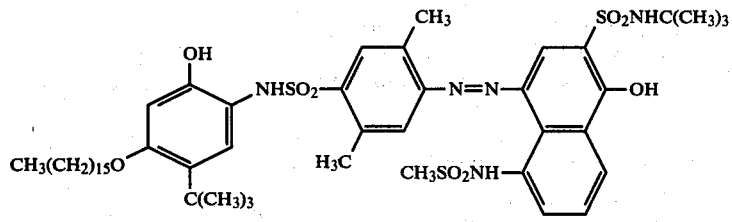

(5) Layer containing a green-sensitive internal latent image type direct reversal silver bromide emulsion (0.82 g/m$^2$ of silver), 0.9 g/m$^2$ of gelatin, 0.04 mg/m$^2$ of the nucleating agent having the following structure, and 0.12 g/m$^2$ of 2-sulfo-5-n-pentadecylhydroquinone.-sodium salt.

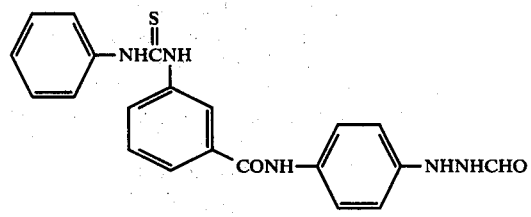

(6) Color mixing inhibitor-containing layer containing 1.0 g/m$^2$ of gelatin and 0.80 g/m$^2$ of a 2,5-di-t-pentadecylhydroquinone eutectic mixture.

Photographic material (B)

Same as photographic material (A) except that a layer containing 1.0 g/m$^2$ of gelatin, 0.80 g/m$^2$ of a 2,5-di-t-pentadecylhydroquinone eutectic mixture, and 0.5 g/m$^2$ of methylmethacrylate polymer was used in place of the color mixing inhibitor-containing layer (6).

Photographic material (C)

Same as photographic material (A) except that a layer containing 1.0 g/m$^2$ of gelatin, 0.80 g/m$^2$ of a 2,5-di-t-pentadecylhydroquinone eutectic mixture, and 1.0 g/m$^2$ of a methyl methacrylate polymer was used in place of the color mixing inhibitor-containing layer (6).

Photographic material (D)

Same as photographic material (A) except that a layer containing 1.0 g/m$^2$ of gelatin, 0.80 g/m$^2$ of a 2,5-di-t-pentadecylhydroquinone eutectic mixture, and 1.0 g/m$^2$ of vinyl acetate polymer was used in place of the color mixing inhibitor-containing layer (6).

A cover sheet was prepared by coating a transparent polyester film support with the following layers (1') to (3').

(1') Layer containing 22 g/m$^2$ of a copolymer of acrylic acid and butyl acrylate at 80:20 by weight ratio and 0.44 g/m$^2$ of 1,4-bis(2,3-epoxypropoxy)butane.

(2') Layer containing 3.8 g/m$^2$ of acetyl cellulose (which can form 39.4 g of acetyl group by the hydrolysis of 100 g of the acryl cellulose), 0.2 g/m$^2$ of a copolymer of styrene and maleic anhydride at 60:40 by weight ratio, and 0.115 g/m$^2$ of 5-($\beta$-cyanoethylthio)-1-phenyltetrazole.

(3') Layer containing 2.5 g/m$^2$ of a copolymer latex of vinylidene chloride, methyl acrylate, and acrylic acid at 85:12:3 by weight ratio and 0.05 g/m$^2$ of a polymethyl methacrylate latex (particles size of 1–3 $\mu$m).

The processing solution having the following composition was prepared.

| | |
|---|---|
| 1-p-Tolyl-4-hydroxymethyl-4-methyl-3-pyrazolidone | 5.8 g |
| Methylhydroquinone | 0.3 g |
| 5-Methylbenzotriazole | 3.5 g |
| Sodium sulfite (anhydrous) | 0.2 g |
| Carboxymethyl cellulose sodium salt | 58 g |
| Potassium hydroxide (28% aq. soln.) | 200 ml |
| Benzyl alcohol | 1.5 ml |
| Carbon black | 150 g |
| Water to make | 685 ml |

Each of photographic materials (A) to (D) described above was exposed through a wedge having stage-wise density differences was combined in a body with a container containing the above-described processing solution and the cover sheet described above, and the processing solution was spread by means of a pressing member between the two elements under a condition of 25° C. to provide transferred dye images. After 30 minutes since the spread of the processing solution, the cover sheet was separated from the photosensitive material and then the photosensitive material was fixed and washed with water.

The densities of developed silver and the transferred color images were determined and the relation between the developed silver and the transferred color images was determined. The results show that photographic materials (B) to (D) of this invention using the polymers of this invention gave higher dye densities for the same developed silver than that of comparison material (A).

EXAMPLE 5

Photographic materials (E), (F) and (G) were prepared in a manner similar to Example 4 except that Compound (33) was employed as the hydroquinone derivative, and (E), (F) and (G) comprised:

(E): 0.5 g of Compound (33) alone (for comparison)

(F): 0.5 g of Compound (33)+0.5 g of methyl methacrylate polymer (G): 0.5 g of Compound (33)+1.0 g of methyl methacrylate polymer Each of photographic materials (E) to (G) was exposed, developed, fixed and washed as described in Example 4.

The densities of developed silver and the transferred color images were determined, and the relation between the developed silver and the transferred color images was determined.

The results show that photographic materials (F) and (G) of this invention gave higher dye densities for the developed silver than that of comparison photographic material (E). The improved dye density obtained with photographic material (G) compared with photographic material (F) indicates that as the amount of the polymer is increased the dye density increases also.

While the invention has been described in detail and with reference to specific embodiments thereof, it will be apparent to one skilled in the art that various changes and modifications can be made therein without departing from the spirit and scope thereof.

What is claimed is:

1. A photographic material comprising:

a support;

a plurality of silver halide photographic emulsion layers on said support, said layers capable of forming silver images by processing with an alkaline processing composition in the presence of a silver halide developing agent after light-exposure;

an interlayer disposed between said silver halide photographic emulsion layers, said interlayer comprising a mixture of hydroquinone derivatives having a solidifying point below 100° C., and a water-insoluble organic solvent-soluble homopolymer or copolymer comprising a main chain or a side chain which includes a recurring unit, said recurring unit including a $$(-\underset{\underset{O}{\|}}{C}-O-)\text{ group,}$$

combined particles of said derivatives and said homopolymer or copolymer dispersed in a hydrophilic organic colloid.

2. A photographic material as claimed in claim 1, wherein said silver halide photographic emulsion layers are closely connected with a dye-releasing redox compound capable of releasing a diffusible dye, said dye being diffusible into an image-receiving layer in order to form a transferred image, said releasing brought about by a redox reaction with an oxidation product of said silver halide developing agent formed by processing said photographic material with an alkaline processing composition in the presence of said silver halide developing agent after light-exposure.

3. A photographic material as claimed in claim 1, wherein said silver halide photographic emulsion layers are capable of forming dye images by processing said photographic material with an alkaline processing composition in the presence of an aromatic binary amine as said silver halide developing agent, and dye image forming couplers after light-exposure.

4. A photographic material as claimed in claim 1, wherein said mixture of hydroquinone derivatives possesses a color mixing inhibiting property, is substantially incapable of developing silver halide and has a solidifying point below 80° C.

5. A photographic material as claimed in claim 4, wherein said mixture of hydroquinone derivatives is in a liquid or waxy state at room temperature.

6. A photographic material as claimed in claim 1, wherein said hydroquinone derivative mixture is an eutectic mixture of branched alkylhydroquinones.

7. A photographic material as claimed in claim 1, wherein said hydroquinone derivative mixture is a mixture of hydroquinone compounds each having two tertiary alkyl groups having 15 carbon atoms at the 2- and 5-positions or the 2- and 6-positions of the benzene ring or an isomer mixture of secondary dodecylhydroquinones.

8. A photographic material as claimed in claim 1, wherein said hydroquinone derivative mixture is a mixture of isomers represented by the following general formula (I), (II), (III), (IV), (V) or (VI)

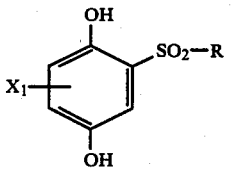

(I)

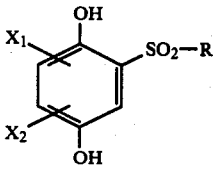

(II)

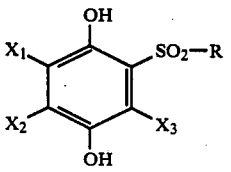

(III)

-continued

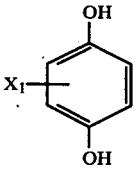

(IV)

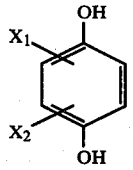

(V)

or

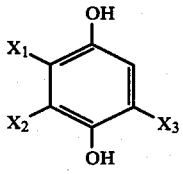

(VI)

wherein $X_1$, $X_2$ and $X_3$, which may be the same or different, each represents halogen atom, an aliphatic group, an aryl group, an alkoxy group, an aryloxy group, an alkylthio group, or arylthio group; said $X_1$ and $X_2$ may form a condensed ring with each other; and R represents an aliphatic group or an aryl group.

9. A photographic material as claimed in claim 8, wherein said hydroquinone derivative mixture is substantially devoid of dye residue of precursors thereof.

10. A composition of matter suitable for use as an interlayer in a multilayer photographic film which generates silver images by the release of diffusible dyes by the redox reaction, comprising:

a mixture of hydroquinone derivatives having a softening point below 100° C.; and a water-insoluble organic solvent-soluble homopolymer or copolymer comprising a main chain or a side chain including a recurring unit, said recurring unit including a $$(-\underset{\underset{O}{\|}}{C}-O-)\text{ group,}$$

wherein said hydroquinone derivatives and said homopolymer or copolymer form a combined particle which is dispersed in a hydrophilic organic colloid.

* * * * *